US005547087A

United States Patent [19]

Licari

[11] Patent Number: 5,547,087

[45] Date of Patent: Aug. 20, 1996

[54] DEVICE FOR HOLDING FLATWARE AND UTENSILS

[76] Inventor: Yaffa Licari, 875 Ocean Ave., Elberon, N.J. 07740

[21] Appl. No.: 258,322

[22] Filed: Jun. 10, 1994

[51] Int. Cl.[6] ..... A47F 7/00

[52] U.S. Cl. ..... 211/41; 211/70.7; D32/55

[58] Field of Search ..... 211/41, 126, 70.7; 248/37.3; D7/637, 638; D32/55, 56

[56] References Cited

U.S. PATENT DOCUMENTS

| | | | |
|---|---|---|---|
| D. 173,711 | 12/1954 | Roop | D32/55 |
| D. 353,921 | 12/1994 | Lippisch et al. | D32/55 |
| 2,739,715 | 3/1956 | Planeta | D32/55 X |
| 3,442,395 | 5/1969 | Taylor | D32/55 X |
| 3,800,957 | 4/1974 | Krause | D32/55 X |
| 4,372,448 | 2/1983 | Drach | D32/55 X |
| 5,012,934 | 5/1991 | Newhall | 211/41 |
| 5,158,184 | 10/1992 | Craft et al. | 211/41 |

*Primary Examiner*—Robert W. Gibson, Jr.
*Attorney, Agent, or Firm*—Morton Chirnomas

[57] ABSTRACT

A dish drying rack comprises an elongated horizontal base frame having a first end portion and a second end portion attached to the first end portion by at least one longitudinal frame member attached to the first and second end portions. The horizontal base frame further has a ratio of overall length to greatest width of at least 1.75:1. Further included are utensil holding means for holding utensils, the utensil holding means being attached to the first member of the base frame along the top surface thereof, and a plurality of flatware holding means for holding flatware in a substantially vertical position. The plurality of flatware holding means are attached to an upper surface of the horizontal base frame and extend therealong from the second end portion of the horizontal base frame to a position adjacent to the utensil holding means. Additionally a plurality of bowl holding means for holding bowls or cups are attached to the horizontal base frame on the top surface of the first end portion around the periphery of the utensil holding means and on the top surface of the second end portion of the base frame.

7 Claims, 7 Drawing Sheets

DEVICE FOR HOLDING FLATWARE AND UTENSILS

FIELD OF THE INVENTION

The present invention relates to a device for holding flatware, utensils for eating and the like on a kitchen counter-top for the purpose of allowing the flatware and utensils to drip dry. More particularly, the present invention relates to a dish drying rack which provides means for supporting a relatively large amount of plates, cups and cutlery and yet has a structure which is far smaller and more ergonomic than other such known devices.

BACKGROUND OF THE INVENTION

The dish drying rack is a very well known item in the housewares industry and has been known for many years in various forms. Essentially, the goal of a dish drying rack is to provide a structure which will support in a somewhat vertical orientation plates, flatware, cups, cookware, silverware, cutlery and utensils after these items have been washed in a sink or tub. In many households, the dish drying rack occupies a nearly permanent station on the countertop beside the kitchen sink. In other households, especially where counterspace is at a premium, the dish drying rack is stored away between periods of use. Even with the advent of the dishwashing machine, most households have a dish drying rack as a standard piece for a properly equipped kitchen.

Typically, plates which are to be dried are held at about vertical orientation and slightly spaced apart to allow air to circulate between the plates thereby decreasing the drying time. The dish drying racks which are most commonly known are made from plastic -coated wire, wood or a moldable thermoplastic resin such as rubberized polypropylene copolymer. Most known dish drying racks take one or a combination of the following general forms. One form, most commonly made from plastic-coated wire and thermoplastic resins, has a framework that takes the overall appearance of a basin, i.e., having four nearly vertical walls surrounding a generally planar floor. The floor is often comprised of a series of parallel crossmembers. In a particular region of these crossmembers there are plate support members vertically extending therefrom, between which users are expected to insert flatware. The plate support members usually have an inverted U-shape or V-shape against which plates and bowls can be leaned. Many of this type of dish drying rack are provided with at least one and usually three or so cup-holding tongues which project slightly outwards from the vertical walls of which they are an integral part. Unfortunately, many cups, bowls and other .items which one may wish to support from cup-holding tongues will not fit therein and must occupy other valuable floor space. The remainder of the floor is devoted to those articles which fit neither between the plate support members nor in the utensil holders.

Another known structure for holding plates in a vertical orientation includes spaced apart ridges, each one describing a concave arc, arranged parallel to one another. The user is required to insert the edge of a plate into the space between two of the concave ridges. The concave ridge design suffers from the disadvantage that the spacing between the ridges cannot accomodate a significant number of flatware conformations. In particular, bowls must have at least a portion of the rim which is substantially planar, which planar rim portion could possibly be inserted between the concave ridges. Any bowl not having a planar rim portion could not efficiently be stored in this second type of dish holding structure.

SUMMARY AND OBJECTS OF THE INVENTION

Therefore, it is one object of the present invention to provide a dish drying rack which makes more efficient use of the consumer's countertop space by having a smaller footprint on said countertop.

It is another object of the present invention to provide a dish drying rack which is able to hold a large complement of utensils, cups and/or bowls, plates and other kitchenware.

It is still another object of the present invention to provide a dish rack which has great ease of storability.

It is yet another object of the present invention to provide an inexpensive dish drying rack from a thermoplastic material such as polypropylene or polyethylene.

The foregoing objectives and others not specifically enumerated herein are accomplished by the present invention which relates generally to an ergonomic structure for a dish drying rack which provides a large dish-holding capacity in a structural combination of integrated components that permit it to be extremely compact in size, very versatile as to the shape of the flatware it will hold, easy to manufacture, easy to ship and easy for a consumer to store.

More particularly, the dish drying rack of the present invention comprises an elongated substantially horizontal base frame having a ratio of overall length to greatest width of at least 1.75:1 and preferably at least 2.25:1. The horizontal base frame has the greatest width and overall length of any portion of the dish drying rack of the present invention, that greatest width being from about 2 inches to about 6 inches and the length being proportioned accordingly.

In one exemplary embodiment of the present invention the horizontal base frame includes a first semicircular end portion having a predetermined radius and a second semicircular end portion having a predetermined radius connected to the first semicircular end portion by at least one longitudinal frame member. The horizontal base member in this embodiment would then have its greatest width equal to the diameter of the semicircular end portions. Other embodiments of the present invention include end members having other geometric conformations, for example, rectangular, triangular, and various polygonal shapes. In all embodiments hereof, the dish drying rack is supplied with flatware holding means, utensil holding means and bowl holding means which are shaped on their upper and lower aspects, or alternatively their outer and inner surfaces, such that a dish drying rack constructed in accordance with one of the exemplary embodiments will be received in a nested manner by a dish drying rack having identical construction placed thereupon. For example, in the embodiment having semicircular end portions the horizontal base frame is provided on the upper surface of one semicircular end portion with means for holding utensils comprising a cup suspended by a plurality of inwardly inclining cup support members attached to the semicircular end portion. Whether semicircular in shape like the semicircular end portion or not, the cross-sectional area of the inner surface of the cup increases as the cup extends upwards away from the horizontal base frame. Each of the cup supports are separated from one another by a predetermined space in which are located vertical inwardly inclining bowl support members which are inclined such that the horizontal base frame of the next dish drying rack will nest over the cup supports without difficulty. The remaining length of the horizontal base frame from the longitudinal frame member to the end of the second semicircular end portion has attached thereto a plurality of flatware holding means which have a conformation to facilitate nesting of one dish drying rack on another.

Nestability is one important feature of the present invention which results in ease and reduced costs of shipping, warehousing, display and home storage in between uses. Therefore, the structure of the product must be carefully designed so that storing nested product over a period of weeks or months does not cause warping or even breakage of the product. These concerns are particularly important when one wishes to produces such a product from polyethylene or polypropylene and their derivatives. More particularly, the rapid production by thermoplastic injection molding of this kind of product results in a product which emerges from the molding machine still rather hot. The gradual cooling which can be critical to product quality can take anywhere from a quarter of an hour to several hours. During this time, and indeed for many weeks afterwards, the plastic of the product can still be rather easily deformed or warped by improper packing and other factors well known to plastic molders. However, due to the high rate at which such a product emerges from the molding machine, it becomes impractical from the standpoint of production space to lay each piece aside to completely cool prior to nesting and packaging in a shipping case of twelve or twenty four pieces, for example. Another context in which close nestability is a factor is in reducing breakage of the product due to shifting or exposure to extreme cold during shipping.

In all of the above cases, a key factor is to increase to as great a degree as possible the contact between the upper surfaces or aspects of the lower product with the lower surfaces or aspects of the upper product in the nested position. However, this preferably should be accomplished without promoting the forceful packing together of the products, i.e. by designing a structure as in the present invention in which the base frame has the greatest cross-sectional area and the area decreases relatively uniformly from the base up to the top. Additionally, the lower surfaces of the structure should be similarly designed so that downward protrusions or other impediments to nesting are eliminated or at least confined to areas where they will not make contact with a lower piece nested therein.

Another factor relating to the cost-effective production of the invention relates to constructing a dish drying rack which has as little bulk as possible, yet provides sufficient stability to hold most kitchenware, flatware, silverware and the like. Great care must be given to designing a lightweight structure which will withstand the use and, often, abuse which a dish drying rack endures.

Keeping the nestability factor in mind, exemplary embodiments described hereinbelow are provided with bowl holding means which are formed by the cooperation of parts of the flatware holding means and utensil holding means with slightly inclined but nearly vertical freestanding bowl support members strategically positioned on the horizontal base frame. Moreover, another feature found in the preferred embodiments is the means employed for automatically positioning and balancing flatware in the optimal position on the horizontal base frame. This function is especially notable in a dish drying rack structure which does away with the walls common to most known conventional dish racks and especially so where one has so little bulk and such a relatively narrow footprint. This feature is achieved by a combination of unique structure design and strategic positioning which allows the cooperative action of the plate rim positioning means provided on the upper surface of the horizontal base frame with the plate support means that support the back of a plate leaned thereagainst and the plate inclining means which promote the backwards leaning of a plate placed therein.

BRIEF DESCRIPTION OF THE DRAWINGS

For a more complete understanding of the present invention, reference may be had to the following detailed description of several exemplary embodiments taken in conjunction with the accompanying figures of the drawings, in which.

DETAILED DESCRIPTION OF THE EXAMPLARY EMBODIMENTS

Figure 1:
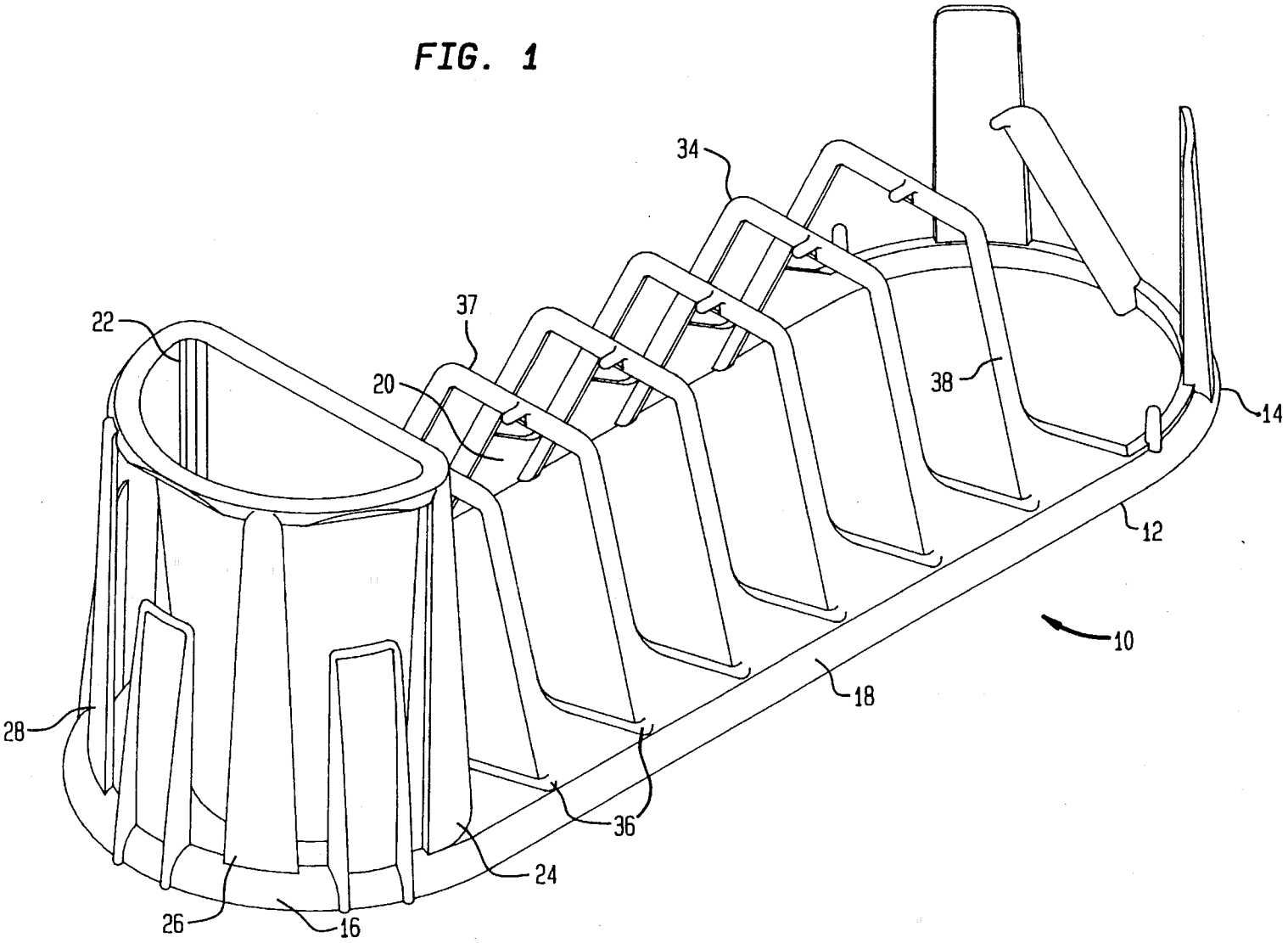
FIG. 1 is a perspective view of one embodiment of a dish drying rack constructed in accordance with the present invention.
Figure 2:
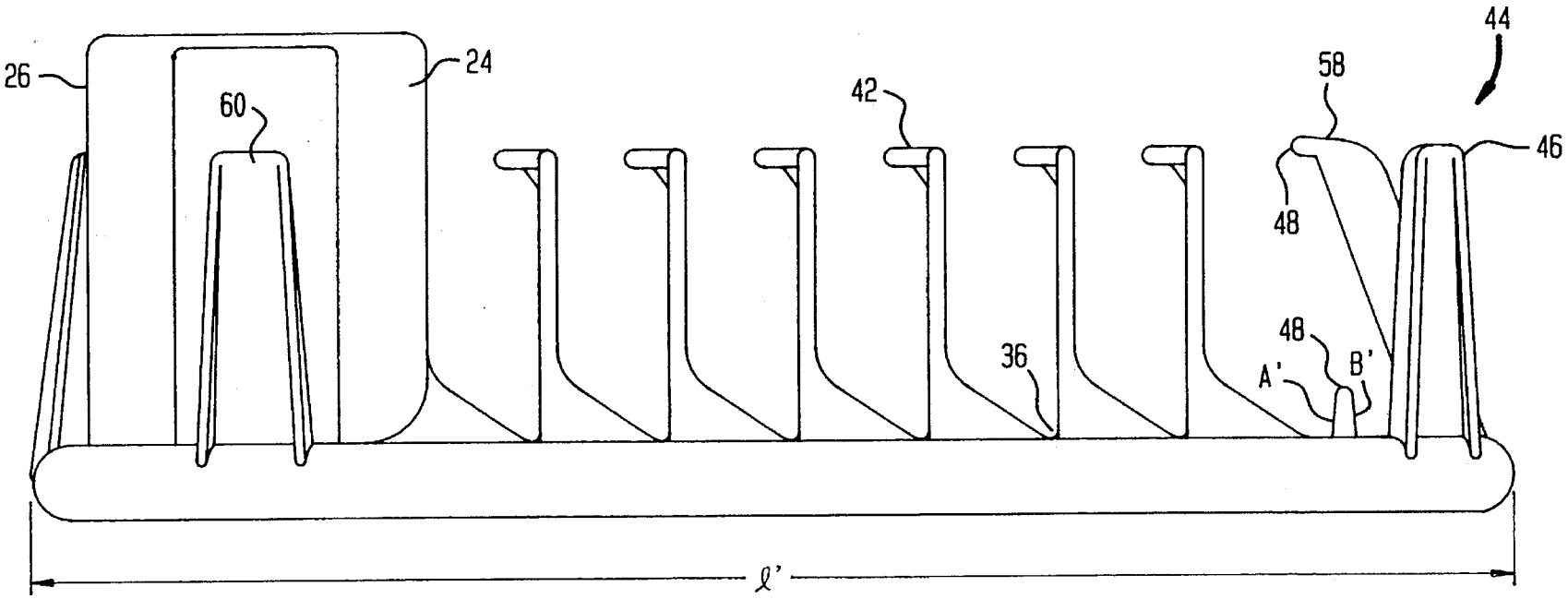
FIG. 2 a side elevational view of the dish drying rack constructed in accordance with the present invention and illustrated in FIG. 1.
Figure 3:
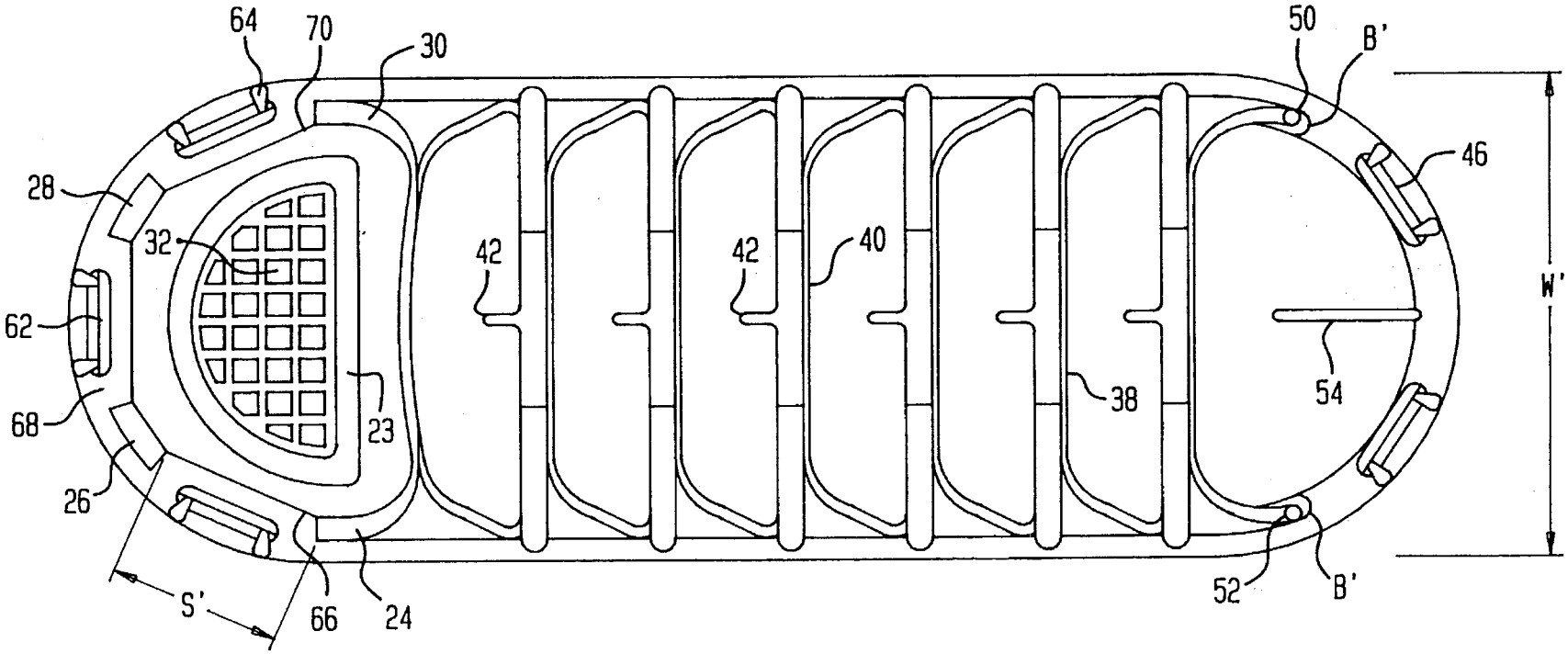
FIG. 3 is top plan view of the dish drying rack constructed in accordance with the present invention and illustrated in FIG. 1.
Figure 5:
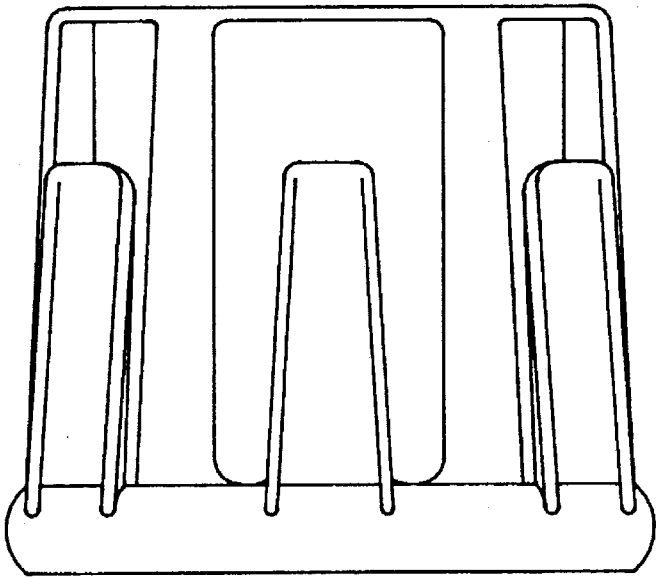
FIG. 5 is a left side elevational view of the dish drying rack constructed in accordance with the present invention and illustrated in FIG. 1.
Figure 4:
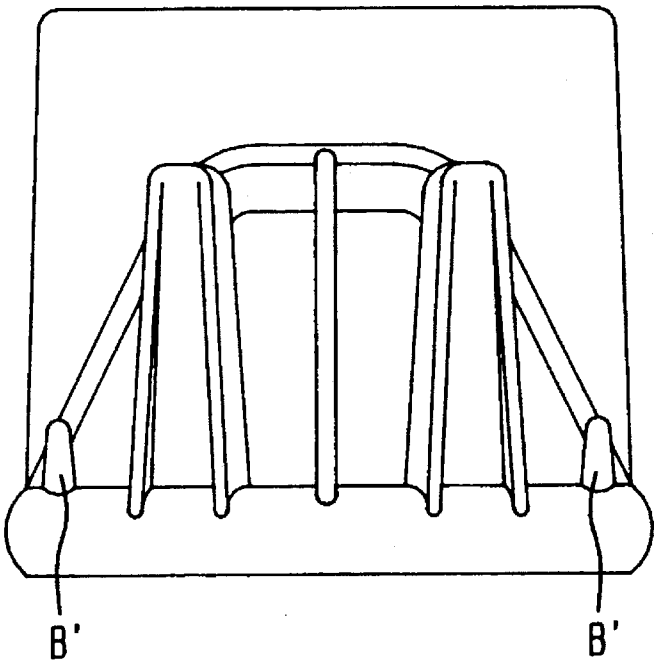
FIG. 4 is a right side elevational view of the dish drying rack constructed in accordance with the present invention and illustrated in FIG. 1.
Figure 6:
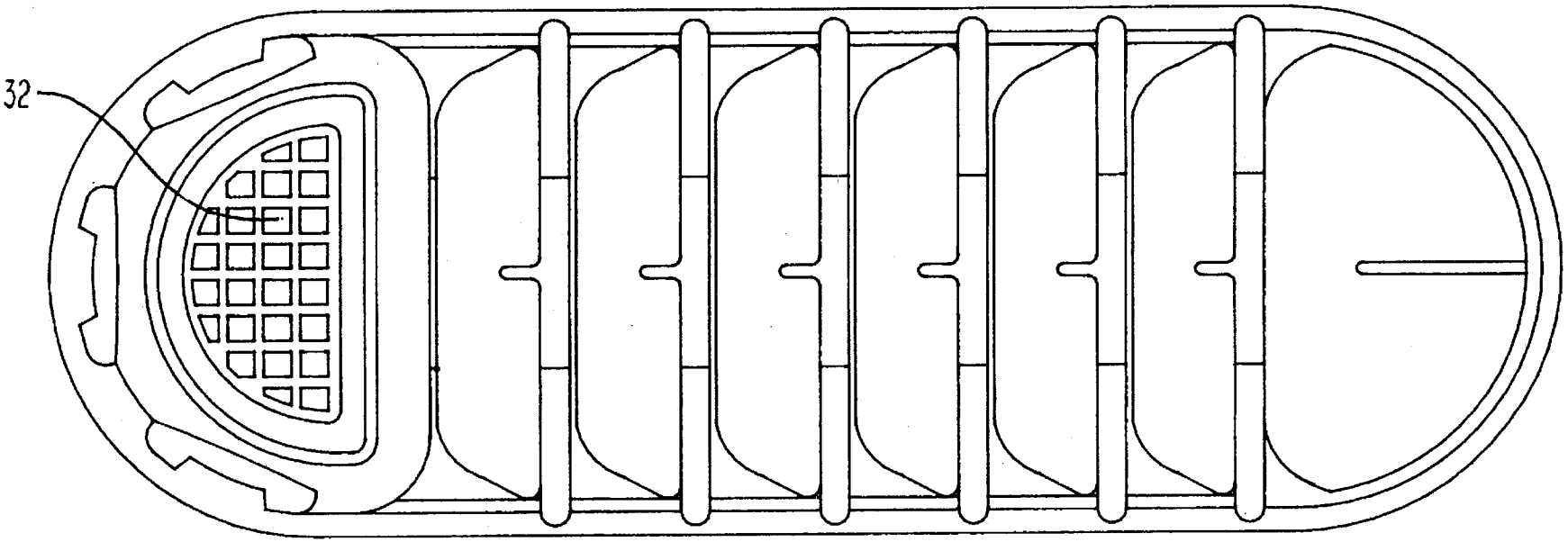
FIG. 6 is a bottom plan view of the dish drying rack constructed in accordance with the present invention and illustrated in FIG. 1.
Figure 7:
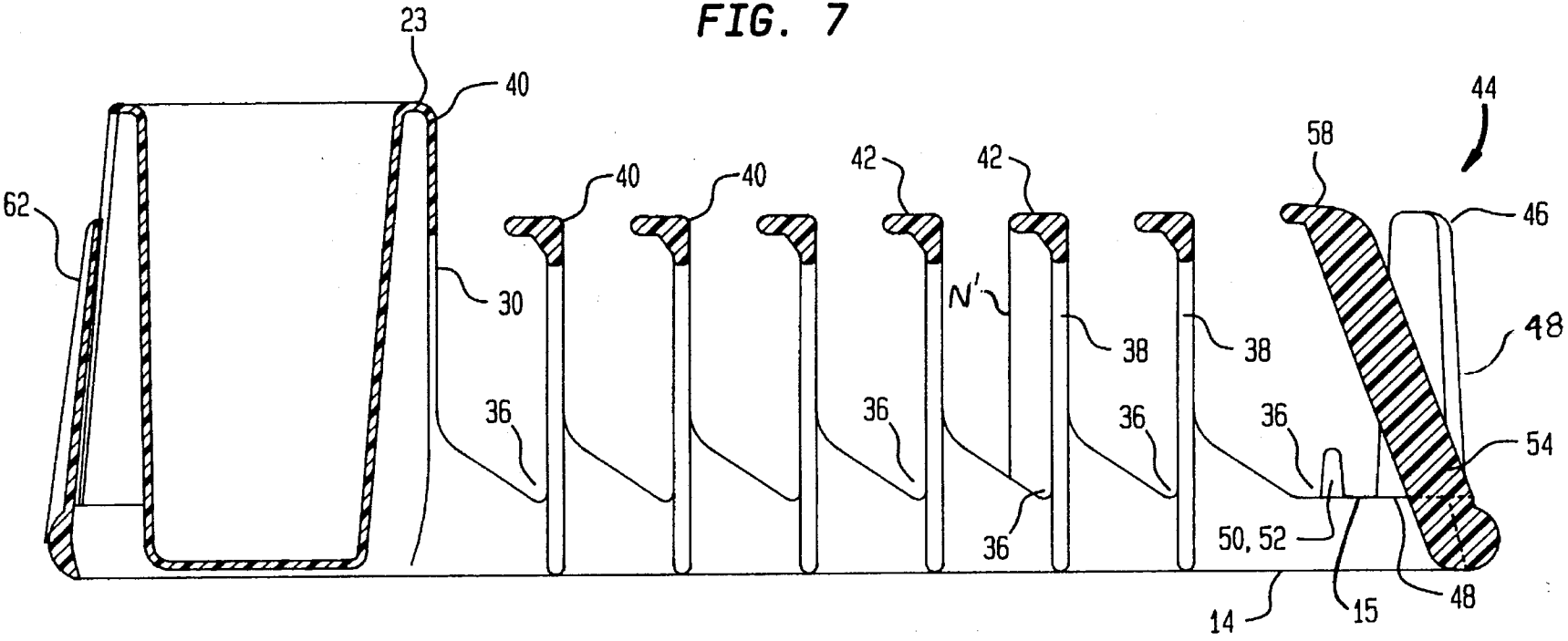
FIG. 7 is a cross-sectional view of the dish drying rack constructed in accordance with the present invention and illustrated in FIG. 2 and taken along line 7—7 thereof and looking in the direction indicated by the arrows.

With reference to the Figures, there is shown a dish drying rack 10 comprising an elongated substantially horizontal base frame 12 having an end portion 14 and 16 at each end of base frame 12. As best seen in FIG. 6, end portions 14,16 have a semicircular shape as viewed in the bottom plan aspect and are connected to one another by logitudinal frame members 18 and 20 which extend therebetween. The overall width w' of dish drying rack 10 is generally at least as large as the distance between frame members 18,20 and ranges from about two inches to about six inches in width and preferably is from three to about five inches. There exists relationship between w' and the overall length 1' of horizontal base frame 12 such that the ratio of 1' to w' is at least 1.75:1 and preferably at least 2.25:1, thus w' will have range from about two inches to about six inches and 1' will have a minimum length of three and a half inches but will preferably range from as short as six and one half inches to about thirteen and one half inches or longer depending on the intended market for the product. For example, longer lengths may be desirable where it is anticipated that larger numbers of flatware pieces will be utilized.

Extending upward from the top surface of end portion 16 are utensil holding means for holding utensils comprising a semicylindrical utensil cup 22 at least three inches deep, suspended atop four vertical utensil cup support members 24, 26, 28 and 30. Utensil cup 22 has a diameter along its top rim 23 about fifteen to twenty percent smaller than overall width w' and is provided at the opposite end with a latticed or perforated bottom 32 to allow drainage. The inner walls 34 of utensil cup 22 are dimensioned such that the radius of the semicylinder near the top of utensil cup 22 is from fifteen to thirty percent (15–30%) larger than the radius near the bottom 32. Utensil cup support members 24, 26, 28, and 30 are attached at their upper ends to rim 23 of utensil cup 22 and to an upper surface of end portion 16 at their lower ends, and have a degree of inclination of from about 70 degrees to about 86 degrees (70°–86°). For a reason which will be discussed further hereinbelow, the lower ends of utensil cup support members 24, 26, 28, and 30 are separated on either side from one another by a space s' of at least one inch, measured linearly. The change in cross-sectional radius of utensil cup 22 and the inclination of utensil cup support members 24, 26, 28, and 30 permit the utensil cup 22 of one dish drying rack 10 to be nested within the utensil cup 22 of another similarly dimensioned dish drying rack 10.

Longitudinal frame members 18, 20 are bridged by a plurality of flatware holding means 34 for holding flatware in a position which is typically about one degree to about ten degrees beyond vertical attached at about three quarter inch intervals to the top surface of frame members 18,20 along substantially their entire lengths between end portions 14 and 16. Each of the plurality of flatware holding means 34 comprises several cooperative components. The plate is automatically centered between longitudinal frame members 18,20 in a position which balances the load in the dish drying rack by plate rim positioners 36 which are stops formed above or in the top surface of each longitudinal frame member 18,20. Plate rim positioners 36 help to prevent the rim of a plate from sliding back and forth along the frame members 18,20. A plate placed on plate rim positioners 36 is leaned back against a substantially vertical plate support means 37 consisting essentially of an inverted V-shaped bridge member 38, each end of the V being attached to one of the longitudinal frame members 18,20 and extending in height from one and half inches to about four inches from surface 15, and preferably about two inches to about three inches. The very ends of each bridge member 38 are positioned so that each one also forms a side of a rim positioner 36. Additionally, utensil cup support members 24 and 30 along with the linear portion of utensil cup rim 23 comprise a bridge member 38. The apex 37 of the V-shaped bridge member 38 is provided with a surface 40 on the side of the bridge member 38 opposite that which forms a portion of a rim positioner 36 and a surface 40 is also provided on the linear portion of utensil cup rim 23.

A plate is automatically positioned so that it leans back towards surface 40 of the adjacent plate support means 37 by two cooperative components which together form the plate inclining means. The first of the cooperative components is a projection pin 42 positioned on each V-shaped bridge member 38 on the side of the apex 37 opposite surface 40 and extending about a quarter of an inch in length horizontally in the direction of utensil cup 22. The second cooperative component comprises a sloped support member 44 extending upward from each plate rim positioner 36 in the direction of utensil cup 22 to the leg of the V-shaped bridge member 38. Sloped support member 44 extends a distance of about one half of an inch to three quarters of an inch up each leg above longitudinal frame members 18, 20. Thus when a plate is inserted between adjacent V-shaped bridge members 38 with the concave side of the plate facing projection pin 42, the convex side of the plate contacts the sloped support members 44 which steer the plate's rim into the plate rim positioners 36 beyond normal line N' drawn up from surface 15 to the tip of projection pin 42 thus bringing an upper part of the plate into contact with projection pin 42 and causing the plate to be tilted backwards towards surface 40. The combination of these components and contemplated variants thereof allow a plate to be easily inserted into dish drying rack 10 and be automatically oriented without much thought and with practically no effort on the part of the consumer.

Extending upward from the top surface of end portion 14 are a plurality of bowl holding means 44 for holding bowls or cups, comprising several cooperative components. Free-standing bowl support members 46 project substantially vertically upwards from the upper surface of horizontal base frame 12 with a slight inclination in the direction of utensil cup 22 of from two degrees to as much as fifteen degrees from vertical, and preferably about three degrees to about five degrees. Bowl support members 46 have a length of at least two inches and a cross-sectional area sufficient to impart the rigidity needed to support a bowl, cup, pot or pan leaned thereagainst. Bowl support members 46 cooperate with rim positioning members 48 in catching and securely holding the rims of bowls, cups or even pots and pans which are positioned thereon.

Rim positioning members 48 include at least two of the following: pins 50 and 52 and/or terminal plate member 54, one of each being attached to upper surface 15 of end portion 14 on either side of and equidistant to each of bowl support members 46. Pins 50 and 52 project upwards about one quarter of an inch to three eighths of an inch above surface 15 of end portion 14. Terminal plate member 54 is attached to surface 15 at a position exactly in line with apexes 37 and also projects upward from surface 15 inclining in the direction of end portion 16 forming an angle of from forty-five degrees to about sixty-five degrees with horizontal base frame 12. At the end of terminal plate member 54 there is provided a projection pin 58 similar in size, orientation and function to projection pins 42 and which also forms a part of the outermost flatware holding means 34 adjacent to and part of end portion 14. Pins 50 and 52 each provide two points of contact, A' and B', with A' facing the side of end portion 16 and with B' facing the nearest bowl support member 46, thereby allowing Pins 50 and 52 to serve the dual purpose of being the plate rim positioners 36 for the outermost flatware holding means 34 as well as being a cooperative part of bowl holding means 44. Thus a bowl (as an example) is supported by the dish drying rack 10 by turning the concave side down and sliding the rim of the object down so that one point of the rim contacts (or nearly contacts) surface 15 between pin 50 (or 52) on one side of the adjacent bowl support member 46 and another point on the object's rim contacts (or nearly so) surface 15 between the same bowl support member 46 and terminal plate member 54. The object's position is then adjusted so that the outer surface thereof contacts point A' (or B') and the base of terminal plate member 54. The bowl can then be allowed to lean outward against bowl support member 46 where it is held in place by the contact points A' and terminal plate member 54.

In order to allow bowls, cups and other such objects to fit and be held by the bowl holding means 44 it should be noted that bowl support members 46 do not lie in a straight line with pin 50 (or pin 52) and terminal plate member 54. To allow for objects having various radiis and curvatures, the distance of the bowl support member 46 from the line between pin 50 (or pin 52) and terminal plate member 46 can be adjusted accordingly.

Returning our attention now to end portion 16, it was previously described hereinabove that a space S' of at least one inch needs to be provided between utensil cup support members 24–26, 26–28 and 28–30. Between each of these pairs of utensil cup support members 24–26, 26–28 and 28–30 there is attached to surface 15 of horizontal base frame 12 bowl support members 60, 62 and 64, respectively. The bases of the cup support members 24–26, 26–28 and 28–30 have the dual function of rim positioners, in a manner similar to pins 50 and 52 and the base of terminal support member 46. Therefore, as an example, a cup's or bowl's rim is inserted over bowl support member 60 and between the utensil cup support member 26 on one side and between bowl support member 60 and utensil cup support 28 on the other side. The cup or bowl is pushed down as far as possible until it is either securely held or the rim contacts surface 15. Freestanding bowl support members 60, 62 and 64 project substantially vertically upwards from surface 15 with a slight inclination in the direction of utensil cup 22 of from two degrees to as much as fifteen degrees from vertical, and preferably about three degrees to about five degrees. Bowl support members 60, 62 and 64 have a length of about two inches and a cross-sectional area sufficient to impart the rigidity needed to support a bowl, cup, pot or pan leaned thereagainst.

Because it is expected that the dish drying rack 10 of the present invention will be nested one atop the next, various features have been incorporated to facilitate nesting without damage caused by warping or freezing as discussed hereinabove. As an example of such a feature, the utensil cup 22, which is substantially semicircular in its top plan view appearance has been provided with a rim 23 which is flattened in areas 66, 68 and 70 which are directly above bowl support members 60, 62 and 64 respectively. When one dish drying rack is nested down onto two others, the base frame 12 of the upper rack presses in against the top ends of the bowl support members 60, 62 and 64 of the middle dish drying rack. These in turn would compress against the outer rim 23 of cup 22 of the lowermost rack causing either a warping of bowl support members 60, 62 and 64 or warping and possible breakage of cup 22 during a long period of time or as a result of simply shipping the products.

Figure 8:
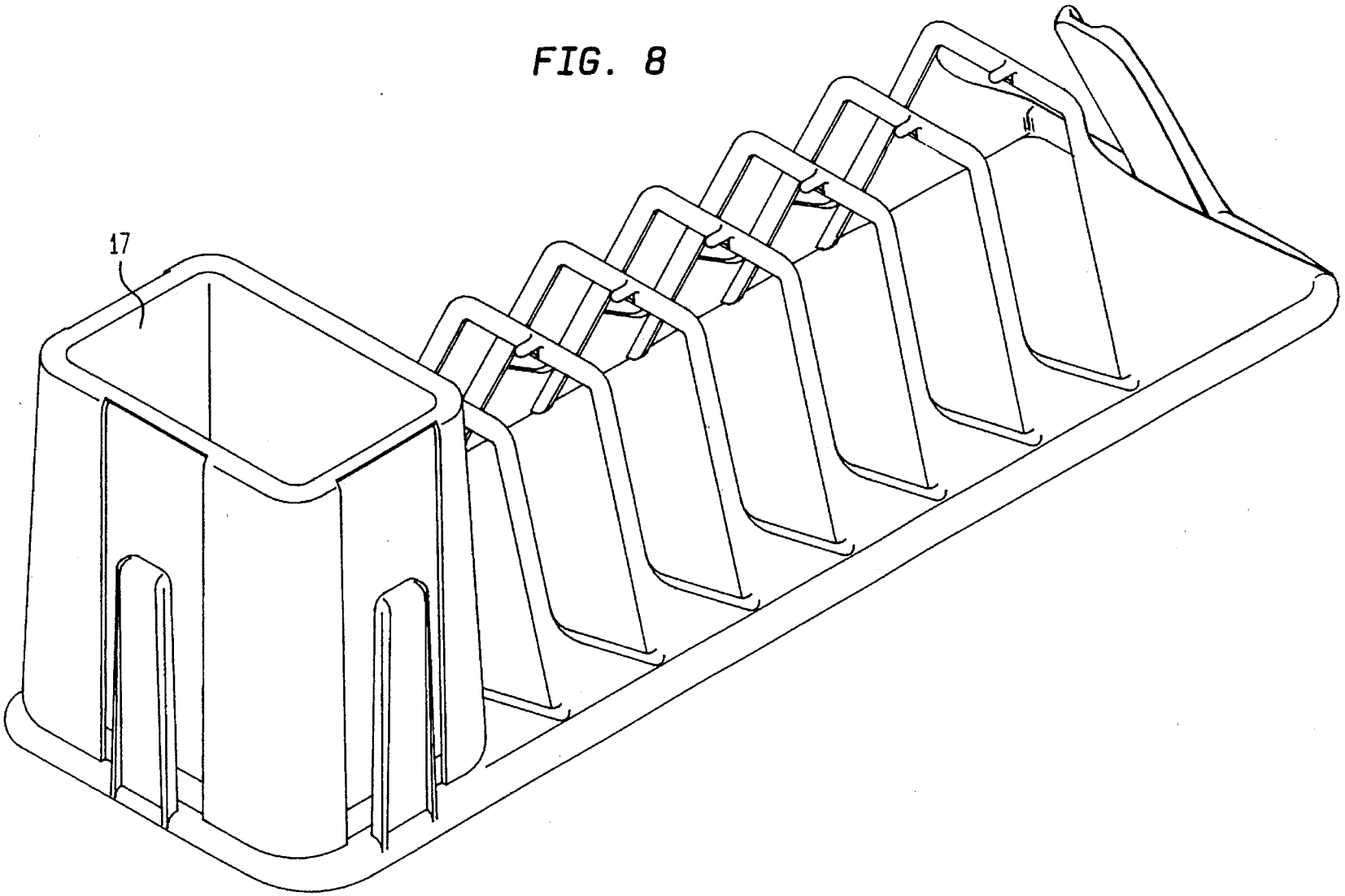
FIG. 8 is a perspective view of another exemplary embodiment of a dish drying rack constructed in accordance with the present invention.

It will be understood that the embodiments described herein are merely exemplary and that a person skilled in the art may make many variations and modifications without departing from the scope and spirit of the invention. For example, as shown in FIG. 8, the utensil holding means 17 can have a generally rectangular appearance as long as the principles described hereinabove for relative positioning of the cooperative components enunciated herein are abided by. All such modifications and variations are intended to be included within the scope of the invention as defined in the appended claims.

I claim:

1. A dish drying rack comprising:

(a) a substantially horizontal elongated base frame comprising a first end portion and a second end portion attached to said first end portion by at least one longitudinal frame member, said base frame having ratio of overall length to greatest width of at least 1.75:1, and having a minimum width of two inches;

(b) utensil holding means for holding utensils, said utensil holding means comprising a cup and at least two cup support members, said cup support members being attached to said upper surface of said base frame at said first end portion and extending substantially vertically upward from and nearly perpendicular to said base frame with a degree of inclination from vertical of about 3 degrees to as much as 20 degrees in towards the longitudinal axis of said base frame, said cup being attached to said at least two cup support members and having a depth of at least three inches and having an inner surface which is outwardly inclining from bottom to top at an angle of from 3 degrees to about 20 degrees such that the interior cross-sectional area thereof is increasing from bottom to top, and having an outer surface complementary to said inner surface, said outer surface of said cup outwardly inclining from bottom to top at an angle of from 3 degrees to about 20 degrees from vertical;

(c) a plurality of flatware holding means for holding flatware in a substantially vertical position, said plurality of flatware holding means being integrally attached to the top of said at least one longitudinal frame member and extending in a linear arrangement therealong from said second end portion to a point adjacent to said utensil holding means; and (d) a plurality of bowl holding means for holding bowls or cups, said plurality of bowl holding means being integrally attached to the top outer edge of said horizontal base frame on said first end portion surrounding said utensil holding means and on said second end portion, said bowl holding means comprising bowl support members extending upwardly from said base frame and having an inward degree of inclination of from two degrees to as much as fifteen degrees from vertical.

2. A dish drying rack in accordance with claim 1, wherein each of said plurality of flatware holding means consists of the following cooperative parts:

plate rim positioning means for positioning the rim of a plate on said horizontal base frame, said plate rim positioning means being attached to said base frame;

plate support means for supporting the back of a plate leaned thereagainst; and plate inclining means for causing a plate to be leaned back against said plate support means.

3. A dish drying rack in accordance with claim 1, wherein each of said plurality of bowl holding means consists of the following cooperative parts:

a bowl support member projecting substantially vertically upwards from the top edge of said horizontal base frame; and two rim positioning members attached to and projecting substantially vertically upwards from the upper surface of said horizontal base frame, said rim positioning members being positioned equidistantly on opposite sides of said bowl support member.

4. A dish drying rack in accordance with claim 2, wherein each of said plurality of bowl holding means consists of the following cooperative parts:

a bowl support member projecting substantially vertically upwards from the top edge of said horizontal base frame; and two bowl rim positioning members attached to and projecting substantially vertically upwards from the upper surface of said horizontal base frame, said rim positioning members being positioned equidistantly on opposite sides of said bowl support member.

5. A dish drying rack in accordance with claim 4, wherein a lower portion of at least one of said plate inclining means comprises one of said bowl rim positioning members.

6. A dish drying rack in accordance with claim 4, wherein lower portion of at least one of said cup support members comprises one of said bowl rim positioning members.

7. A dish drying rack in accordance with claim 5, wherein a lower portion of at least one of said plate inclining means comprises one of said bowl rim positioning members.

* * * * *